United States Patent [19]

Niwa et al.

[11] 4,108,951

[45] Aug. 22, 1978

[54] ACCELERATOR PUMP SYSTEM

[75] Inventors: Takao Niwa; Mamoru Yoshioka; Takao Tate, all of Susono, Japan

[73] Assignee: Toyota Jidosha Kogyo Kabushiki Kaisha, Toyota, Japan

[21] Appl. No.: 773,548

[22] Filed: Mar. 2, 1977

[30] Foreign Application Priority Data

Dec. 28, 1976 [JP] Japan ..... 51-157418

[51] Int. Cl.[2] ..... F02M 7/08

[52] U.S. Cl. ..... 261/34 B; 417/14; 261/39 A

[58] Field of Search ..... 261/34 B, 39 A; 417/14

[56] References Cited

U.S. PATENT DOCUMENTS

| | | | |
|---|---|---|---|
| Re. 22,742 | 4/1946 | Ericson | 261/34 B |
| 2,057,739 | 10/1936 | Prentiss | 261/34 B |
| 2,158,777 | 5/1939 | Renner | 261/39 A |
| 2,355,346 | 8/1944 | Weber | 261/39 A |
| 2,854,225 | 9/1958 | Skay | 261/39 A |
| 2,877,996 | 3/1959 | Kinney et al. | 261/34 B |
| 3,618,904 | 11/1971 | Woods | 261/39 A |
| 3,796,413 | 3/1974 | Woods | 261/39 A |
| 3,911,061 | 10/1975 | Obermeyer, Jr. et al. | 261/34 B |

*Primary Examiner*—Tim R. Miles

*Attorney, Agent, or Firm*—Toren, McGeady & Stanger

[57] ABSTRACT

An accelerator pump system is provided which consists of a pump cylinder having an intake port communicating with a float bowl and a discharge port communicated with an acceleration nozzle or pump jet which injects fuel into the throat of a carburetor. The accelerator pump includes a pump plunger which is reciprocally movable within the pump cylinder in response to pivotal movement of the throttle lever of the carburetor. A pump lever and a connecting rod including thermally responsive material such as thermo-wax are in linking arrangement between the pump plunger and the throttle lever in a series relationship in order to control the stroke of the pump plunger thereby to control the amount of fuel which is discharged into the carburetor by the pump system. As a result, the amount of fuel discharged, as well as the lever ratio of the pump lever, i.e. the fuel discharging characteristic thereof, may be controlled in response to changes in ambient temperature.

3 Claims, 3 Drawing Figures

ACCELERATOR PUMP SYSTEM

BACKGROUND OF THE INVENTION

The present invention relates generally to accelerator pump systems, and more particularly to an accelerator pump assembly which is capable of varying the amount of fuel discharged therefrom and, accordingly, the fuel discharging characteristics thereof in response to changes in ambient temperature. The invention is particularly concerned with an accelerator pump system of the type which includes a pump cylinder having an intake port communicated with a float bowl and a discharge port communicating with a pump jet.

In the operation of an internal combustion engine for motor vehicles, acceleration of the engine is effected by the depression of an accelerator pedal in order to open the throttle valve of the carburetor of the engine. Rapid opening of the throttle valve will permit a sudden inflow of air. As a result, there occurs a sudden demand for additional fuel in the carburetor because the air-fuel mixture charge of the carburetor becomes temporarily leaner. Carburetors are usually provided with an accelerator pump system in order to provide this extra fuel. However, in prior art systems disadvantages have occurred in that, because a pump plunger is linked to a throttle lever in a thermally rigid or unresponsive manner, the stroke of the pump plunger and its lever ratio are maintained constant at all times, regardless of changes in ambient temperature, with the result that fuel of an amount proportionate to the throttle opening is injected through the pump jet or the acceleration nozzle of the system without provision for the change in ambient temperature conditions.

For this reason, at low ambient temperature there results a mixture charge which is leaner than the optimum mixture charge which would be desired. Further, at higher ambient temperatures, there results a mixture charge which is richer than the optimum mixture charge desired. In either case, the proper and optimum operation of the engine is adversely affected, with a resulting increase in the amount of harmful or obnoxious constituents of the exhaust gases being emitted from the engine.

Of course, such a result is not desirable from the viewpoint of emission control of the vehicle.

Accordingly, it is an object of the present invention to provide an accelerator pump system for use with the carburetor of a motor vehicle which may vary the amount of fuel discharged into the carburetor, and consequently vary its fuel discharging characteristics, in response to changes in ambient temperature.

A further object of the invention is to provide an accelerator pump system which may deliver an optimum amount of additional fuel into the air-fuel mixture of the carburetor when the throttle valve of the engine with which it is associated is opened for acceleration. In this manner, the invention is intended to operate to reduce the amount of harmful constituents of exhaust gases which are emitted from the engine of a motor vehicle.

SUMMARY OF THE INVENTION

Briefly, the present invention may be described as a pump assembly for delivering fuel to the carburetor of an engine which includes a throttle valve and a throttle lever connected thereto, said assembly comprising flow means for delivering fuel through the pump assembly into the carburetor, a pump plunger reciprocally movable within the pump assembly through an injection stroke to inject fuel through the flow means into the carburetor, and connection means connecting the pump plunger to the throttle valve to make the pump plunger movable through its injection stroke in response to movement of the throttle valve, the connection means including thermally responsive means for altering the stroke characteristics of the pump plunger in response to ambient temperature conditions thereby to adjust the quantity of fuel injected into the carburetor in accordance with changes in ambient temperature.

The assembly is formed with a pump cylinder having an intake port which communicates with a float bowl and a discharge port communicating with a pump jet or accelerator nozzle. The pump plunger is reciprocable within the pump cylinder in response to pivotal movement of the throttle lever. The thermally responsive means comprise a material which expands and contracts in response to temperature changes. In the preferred embodiment of the invention, thermo-wax is utilized, with the thermo-wax being built in between the pump lever and a connecting rod which are articulated between the pump plunger and the throttle lever in a series relationship. With changes in ambient temperature, the thermo-wax will expand or contract, thereby altering the stroke characteristics of the pump plunger. As a result, the amount of fuel being discharged by the pump assembly will be altered by virtue of the fact that the lever ratio of the pump lever is altered. Thus, the fuel discharging characteristics of the pump are varied in response to changes in ambient temperature conditions.

By a further aspect of the invention, stopper means may be provided which will limit the length of the stroke of the pump plunger and the thermally responsive material or thermo-wax may be built into the stopper means which may be located within the pump cylinder thereby to control the stroke of the pump plunger for the purposes described above.

For a better understanding of the present invention, reference is made to the following description and accompanying drawings while the scope of the invention is pointed out in the appended claims.

DETAILED DESCRIPTION OF THE PREFERRED EMBODIMENTS

Figure 1:
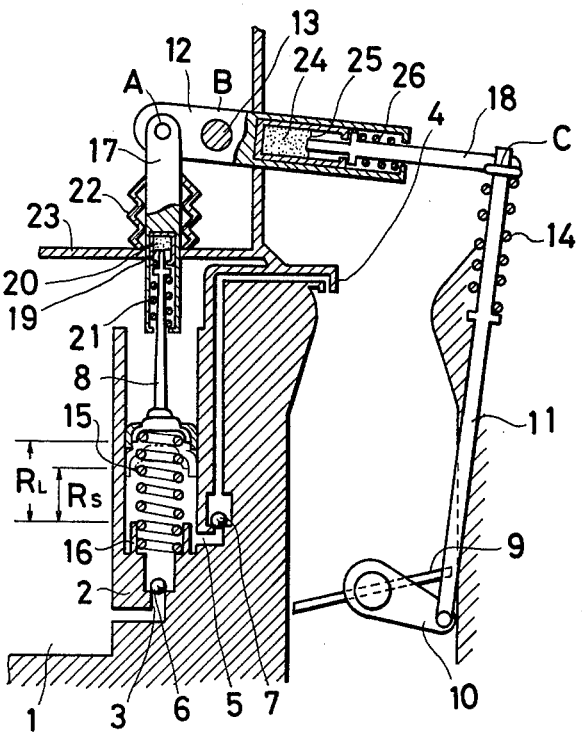
FIG. 1 is a sectional view of an accelerator pump assembly embodying the present invention.

Referring to FIG. 1, there is shown a pump assembly which includes a pump cylinder 2 positioned adjacent to a float bowl 1 of a carburetor, with the pump cylinder 2 having an intake port 3 communicating with the pump bowl and a discharge port 5 communicating with a pump jet or acceleration nozzle for introducing fuel into the throat of a carburetor.

Provided downstream of the intake port 3 is an intake ball check 6. Downstream of the discharge port 5 there is provided a discharge ball check 7. A pump plunger 8 is reciprocably movable within the pump cylinder 2, with the plunger 8 being linked through articulated linking means with a throttle lever 10 of a throttle valve 9 of a carburetor. The articulated linking means consist of a pump connecting rod 11 having one end thereof connected to the throttle lever 10, with its opposite end being connected to a connecting rod 18 which, together with a pump lever 12, forms a rocker arm assembly. The connecting rod 18 is connected with the pump lever 12, which is attached to a connecting rod 17 engaging the pump plunger 8. The pump lever 12 is mounted to rotate or pivot about a fulcrum or pivot mounting 13. A spring 15, engaged between the pump cylinder 2 and the pump plunger 8, applies a spring force tending to drive the pump plunger 8 upwardly. A stopper 16 is provided for limiting the stroke of the pump plunger 8. Connecting rods 17 and 18 are arranged to include therein a thermally responsive material, preferably thermowax, with the rods 17 and 18 being coupled in series with the pump plunger 8 and the pump lever 12, respectively, so that the connecting rods 17 and 18 may be extendable in response to a change in ambient temperature.

The connecting rod 17 coupled to the pump plunger 8 is connected at one end to the pump lever 12 at a pivot point A and at the other end to a cylinder portion which is telescopically fitted upon the pump plunger 8. Within the aforementioned cylinder portion at the other end is a quantity of thermo-wax 20 which contacts the free or upper end of the pump plunger 8 by means of a diaphragm 19. A spring 21 tends to force the pump plunger 8 toward the connecting rod 17 at all times and is located within the cylinder portion on the side of the open end of the cylinder portion of the connecting rod 17. Thus, it will be seen that the pump plunger 8 extends through the open end of the cylinder portion up through the diaphragm 19. A bellows 22 which is adapted to seal the portion of the top wall of the float bowl 1 has the connecting rod 17 extending upwardly therethrough. The connecting rod 18 is coupled at one of its ends to the pump connecting rod 11, with the other end being fitted in a cylinder portion of the pump lever 12 in a telescopic manner. Within the cylinder portion of the pump lever 12 there is provided thermo-wax 24. The thermo-wax 24 contacts the free end of the connecting rod 18 through the medium of the diaphragm 25. Located within the cylinder portion of the pump lever 12 on the side of an open end thereof is a spring 26 tending to urge the connecting rod 18 toward the side of the pivot 13.

Figure 2:
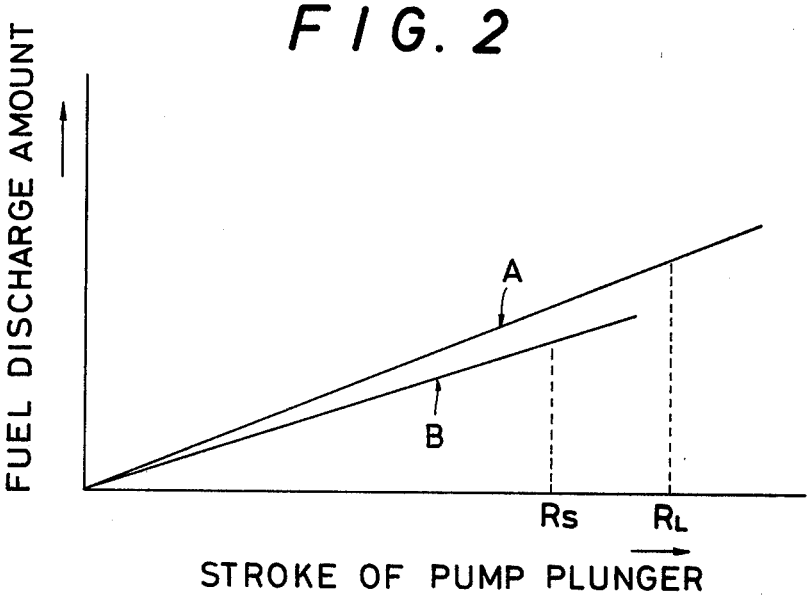
FIG. 2 is a graph showing the relationship between fuel discharge amount in a pump assembly and the stroke of the pump plunger.

In the operation of the device of the present invention, when the ambient temperature is low, the thermo-wax 20 will contract so that the pump plunger 8 will assume a position which is shown in solid line in FIG. 1, which would be a relatively higher position as compared with other stroke positions. When the accelerator pedal (not shown) is depressed and the throttle valve 9 is fully open, the pump plunger 8 will be displaced through a stroke $R_1$ thereby temporarily supplying fuel from the pump cylinder to the discharge port 5 and the pump jet 4 to an engine. In this case, the thermo-wax 24 in the pump lever 12 will also contract so that the lever ratio of $\overline{BC} / \overline{AB}$ is reduced. As a result, the fuel discharging characteristics represented by the line A in FIG. 2 will result. For this reason, when ambient temperature is low, a relatively increased amount of fuel will be supplied as indicated by the fuel discharging characteristics represented by line A as a result of the fact that the pump plunger 8 will be displaced by an increased stroke. The characteristic line A represents an increased fuel discharge amount from an accelerator pump relative to a given opening of the throttle valve 9.

When the ambient temperature is relatively high, the thermo-wax 20 expands so that the pump plunger 8 assumes a position shown by the dotted line form in FIG. 1 representing a lower position. When the accelerator pedal is depressed under this condition, the pump plunger 8 is displaced only by a stroke $R_s$. Additionally, the thermo-wax 24 also expands so that the lever ratio $\overline{BC} / \overline{AB}$ is increased so that the fuel discharge characteristic as shown in line B of FIG. 2 will result. Accordingly, when ambient temperature is relatively high, a reduced amount of fuel is supplied to the engine by means of the pump plunger 8, which is displaced by a reduced stroke $R_s$. Following the fuel discharging characteristic B, there is represented the amount of fuel being discharged which is reduced relative to a given opening of the throttle valve 10.

As will be apparent from the foregoing, the stroke of the pump plunger in the accelerator pump may be automatically adjusted and the lever ratio may be varied in response to changes in ambient temperatures so that an optimal amount of fuel will be supplied to the engine at any acceleration and at any ambient temperature condition. This will result in improved acceleration performance, improved fuel consumption and better emission control. Additionally, the provision of the accelerator pump system of the present invention may dispense with the use of special auxiliary fuel supply equipment thereby simplifying the fuel control system.

Figure 3:
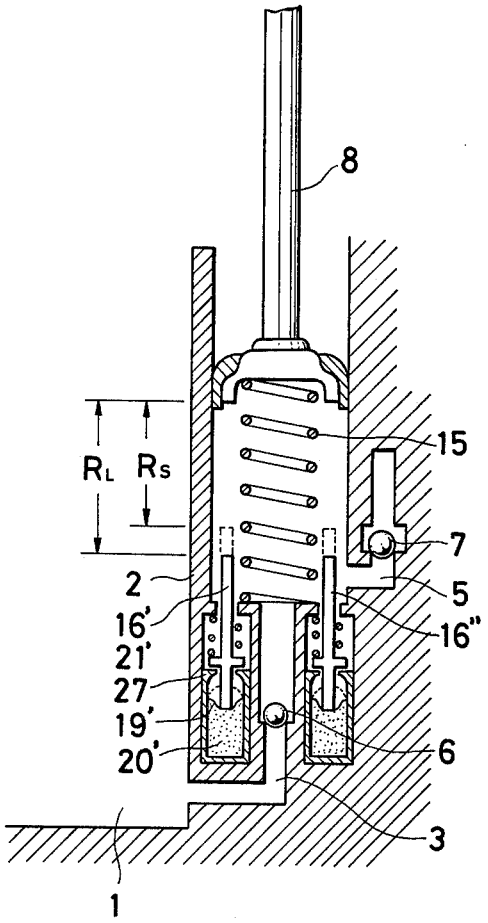
FIG. 3 is a partial sectional view of a part of an accelerator pump system in accordance with a further embodiment of the present invention.

FIG. 3 depicts a further embodiment of the invention. In FIG. 3 there may be provided a stopper 16 which is arranged to limit the lowermost position of the pump plunger 8. Stopper 16 is vertically movably positioned within a cylinder portion 27 provided in the lower portion of the pump cylinder 2. More specifically, thermo wax 20′ is contained with the cylinder portion 27 and contacts the lower end of the stopper 16′ through the medium of a diaphragm 19′. A spring 21′ is housed within the cylinder portion 27 on the side of the open end of the cylinder 27. As a result, the stopper 16′ extends through the aforesaid open end of the cylinder portion 27 upwardly so as to contact the lower end of the plunger 8 when the plunger 8 is depressed. In this case, when ambient temperature is relatively low the stopper 16 will assume a lower position shown by the solid line in FIG. 3 so that the pump plunger 8 may be displaced by a stroke $R_1$, similarly to the stroke previously described. Conversely, when ambient temperature is relatively high, the stopper may assume a higher position shown in broken line so that the pump plunger is displaced by a stroke $R_s$, which is shorter than the stroke $R_1$. Thus, the advantages in function as achieved according to the first embodiment of the invention may also be achieved in accordance with the second embodiment depicted in FIG. 3. By adjusting the vertical position of the stopper 16′, the stroke of plunger 8 may be controlled thereby to control the quantity of fuel which is injected by the pump assembly.

A further modification of the embodiment of FIG. 3 may involve merely provision of a second stopper such as the stopper 16″ which operates in a manner similar to the operation of the stopper 16′ but which is located on the opposite side thereof within the pump cylinder. Provision of a second stopper will aid in balancing of a piston of the pump plunger 8 when lowered and contacting the stoppers.

While specific embodiments of the invention have been shown and described in detail to illustrate the application of the inventive principles, it will be understood that the invention may be embodied otherwise without departing from such principles.

What is claimed is:

1. An accelerator pump assembly for delivering fuel to an engine carburetor which includes a throttle valve, said assembly comprising flow means for delivering fuel through said pump assembly into said carburetor, a rocker arm assembly having a first and a second end, said rocker arm assembly being pivotally mounted at a point intermediate said ends, connecting rod means interconnecting said first end of said rocker arm assembly with said throttle valve of said carburetor to effect pivotal movement of said rocker arm assembly about said intermediate pivot point in response to movement of said throttle valve, a pump plunger assembly mounted to extend from said second end of said rocker arm assembly and reciprocally movable through an injection stroke in response to movement of said throttle valve to inject fuel through said flow means into said carburetor, first thermally responsive means interposed between said intermediate pivot point of said rocker arm assembly and said first end thereof to expand and contract the distance therebetween in response to ambient temperature, and second thermally responsive means interposed as part of the length of said plunger assembly to expand and contract said length thereof by which said plunger assembly extends from said second end of said rocker arm assembly in response to ambient temperature thereby to alter the injection stroke of said plunger assembly, said first and said second thermally responsive means altering the stroke characteristics of said pump plunger assembly in response to ambient temperature conditions thereby to adjust the quantity of fuel injected into said carburetor in accordance with changes in ambient temperature.

2. An assembly according to claim 1 wherein said first and said second thermally responsive means comprise thermal material which expands and contracts in response to ambient temperature.

3. An assembly according to claim 2 wherein said thermal material is thermo-wax.

* * * * *